US011180287B2

(12) United States Patent
Jung

(10) Patent No.: US 11,180,287 B2
(45) Date of Patent: Nov. 23, 2021

(54) TUBE SQUEEZER

(71) Applicant: MORRIS & CO CO., LTD., Chungcheongbuk-do (KR)

(72) Inventor: Tae Bong Jung, Seoul (KR)

(73) Assignee: MORRIS & CO CO., LTD., Chungcheongbuk-Do (KR)

( * ) Notice: Subject to any disclaimer, the term of this patent is extended or adjusted under 35 U.S.C. 154(b) by 0 days.

(21) Appl. No.: 17/267,093

(22) PCT Filed: Aug. 22, 2019

(86) PCT No.: PCT/KR2019/010677
§ 371 (c)(1),
(2) Date: Feb. 9, 2021

(87) PCT Pub. No.: WO2020/040560
PCT Pub. Date: Feb. 27, 2020

(65) Prior Publication Data

US 2021/0163184 A1 Jun. 3, 2021

(30) Foreign Application Priority Data

Aug. 23, 2018 (KR) ..... 10-2018-0098467

(51) Int. Cl.
*B65D 35/28* (2006.01)
*B65D 83/00* (2006.01)

(52) U.S. Cl.
CPC ..... *B65D 35/285* (2013.01); *B65D 83/0055* (2013.01)

(58) Field of Classification Search
CPC ... B65D 35/285; B65D 83/0055; B65D 83/00
(Continued)

(56) References Cited

U.S. PATENT DOCUMENTS 4,354,623 A * 10/1982 Gill ..... B65D 35/285 222/102
6,966,457 B1 * 11/2005 Torbet ..... B65D 35/285 222/101

(Continued)

FOREIGN PATENT DOCUMENTS

EP 0153906 A2 * 2/1985
KR 20-0250616 Y1 10/2001

(Continued)

OTHER PUBLICATIONS

Search Report, dated Nov. 27, 2019, for International Application No. PCT/KR2019/010677.

(Continued)

*Primary Examiner* — Lien M Ngo
(74) *Attorney, Agent, or Firm* — LRK Patent Law Firm

(57) ABSTRACT

A tube squeezer includes: a first main body including first swing arms and a first handle; a second main body including second swing arms and a second handle; a first roller coupled to the first main body and positioned in a section between shafts and the first handle; a second roller coupled to the second main body, and positioned in a section between the shafts and the second handle, wherein second ends of the second swing arms are respectively coupled to second ends of the first swing arms to be swingable by respective shafts; and a pressure member having a preset volume and positioned on an outer surface of a portion where the first main body and the second main body are movably connected to each other.

1 Claim, 6 Drawing Sheets

(58) Field of Classification Search
USPC ..... 222/102–104, 95, 97, 98
See application file for complete search history.

(56) References Cited

U.S. PATENT DOCUMENTS

| | | | | |
|---|---|---|---|---|
| 8,434,644 | B1 * | 5/2013 | Galante | B65D 35/285 222/102 |
| 10,703,061 | B1 * | 7/2020 | Hovhannisyan | B30B 3/04 |
| 2007/0131710 | A1 | 6/2007 | Requardt | |
| 2009/0302054 | A1 | 12/2009 | Crangnolini | |

FOREIGN PATENT DOCUMENTS

| | | | |
|---|---|---|---|
| KR | 10-2005-0013985 | A | 2/2005 |
| KR | 10-2012-0030252 | A | 3/2012 |
| KR | 10-1551717 | B1 | 9/2015 |
| WO | WO 2017/022867 | A1 * | 2/2017 |

OTHER PUBLICATIONS

Written Opinion, dated Nov. 27, 2019, for International Application No. PCT/KR2019/010677.

* cited by examiner

TUBE SQUEEZER

CROSS-REFERENCE TO RELATED APPLICATIONS

The present application is a U.S. National Phase entry from International Application No. PCT/KR2019/010677, filed Aug. 22, 2019, which claims priority to Korean Patent Application No. 10-2018-0098467, filed Aug. 23, 2018, the disclosure of which is incorporated by reference herein in their entirety.

TECHNICAL FIELD

The present disclosure relates to a tube squeezer.

BACKGROUND ART

A tube squeezer may be used to squeeze a tube containing contents. The tube squeezer may have a structure in which two rollers are provided to squeeze contents in a tube while the tube moves between the rollers, as disclosed in Korean Utility Model Registration No. 20-0250616.

DISCLOSURE

Technical Problem

The present disclosure is intended to propose a tube squeezer having improved usability.

Technical Solution

According to the present disclosure achieving the above objectives, there may be provided a tube squeezer. The tube squeezer may include: a first main body having first swing arms spaced apart from each other at a preset distance, and a first handle extending between first ends of the first swing arms in a spacing direction between the first swing arms; a second main body having second swing arms spaced apart from each other at a preset distance, and a second handle extending between first ends of the second swing arms in a spacing direction between the second swing arms, wherein second ends of the second swing arms may be respectively coupled to second ends of the first swing arms to be swingable around a shaft; a first roller extending in a direction defined as the spacing direction between the first swing arms and rotatably coupled to the first main body such that the first roller may be positioned in a section between the shaft and the first handle; a second roller extending in a direction defined as the spacing direction between the second swing arms and rotatably coupled to the second main body such that the second roller may be positioned in a section between the shaft and the second handle; and a pressure member having a preset volume and positioned on an outer surface of a portion where the first main body and the second main body may be movably coupled to each other.

The pressure member may include: a connecting part positioned adjacent to the portion where the first main body and the second main body may be coupled to each other; and a pressure part formed by protruding from the connecting part in a direction outward from the first and second main bodies, the pressure part being configured such that a cross-sectional area thereof defined in a direction perpendicular to a protruding direction of the pressure part may be reduced as the pressure part goes outward from the connecting part.

Advantageous Effects

According to the embodiment of the present disclosure, a tube squeezer having improved usability can be provided.

MODE FOR INVENTION

Figure 1:
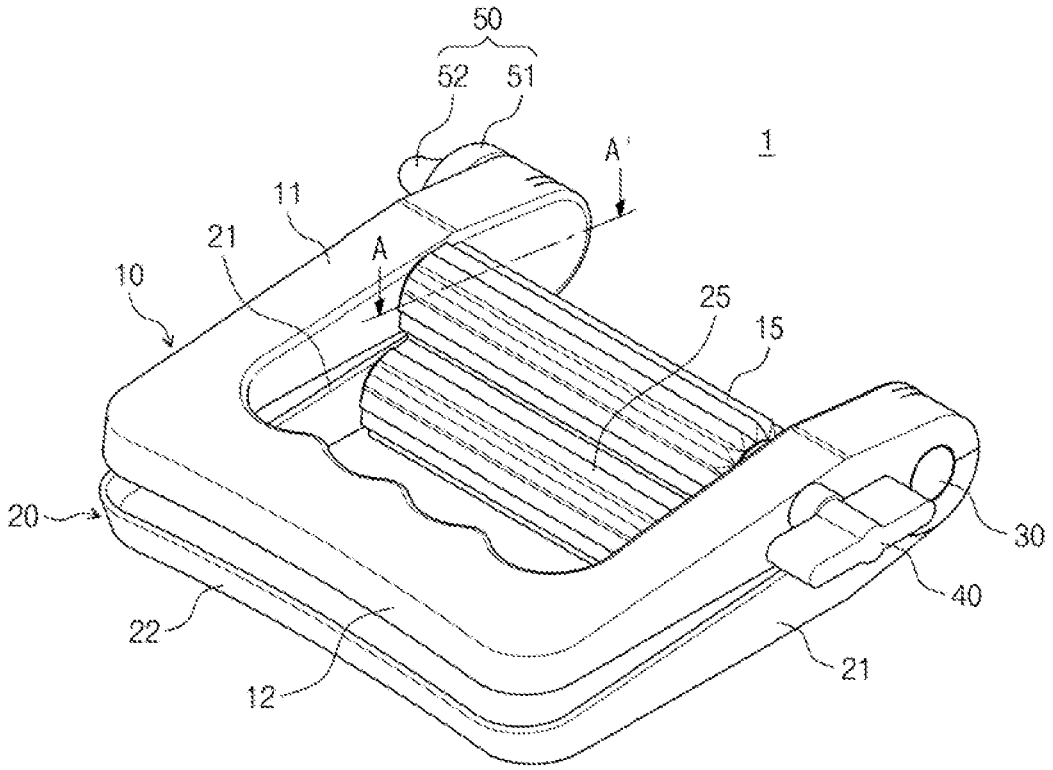
FIG. 1 is a perspective view showing a tube squeezer according to an embodiment of the present disclosure.

Hereinbelow, a preferred embodiment of the present disclosure will be described in detail with reference to the accompanying drawings. It should be understood that the embodiment of the present disclosure may be changed to a variety of embodiments and the scope and spirit of the present disclosure are not limited to the embodiment described below and the present disclosure is not limited to the specific embodiment. The embodiment of the present disclosure described below is provided for allowing those skilled in the art to more clearly comprehend the present disclosure. Therefore, it should be understood that the shape and size of the elements shown in the drawings may be exaggeratedly drawn to provide an easily understood description of the structure of the present disclosure.

FIG. 1 is a perspective view showing a tube squeezer according to an embodiment of the present disclosure.

Referring to FIG. 1, the tube squeezer 1 includes a first main body 10, a second main body 20, and a pressure member 50.

The first main body 10 includes first swing arms 11 and a first handle 12. The first swing arms 11 are configured as rods arranged to be spaced apart from each other at a preset distance. First ends of the first swing arms 11 are connected to each other by the first handle 12 extending in a spacing direction between the first swing arms 11.

The second main body 20 includes second swing arms 21 and a second handle 22. The second swing arms 21 are configured as rods arranged to be spaced apart from each other at a preset distance. First ends of the second swing arms 21 are connected to each other by the second handle 22 extending in a spacing direction between the second swing arms 21.

Figure 2:
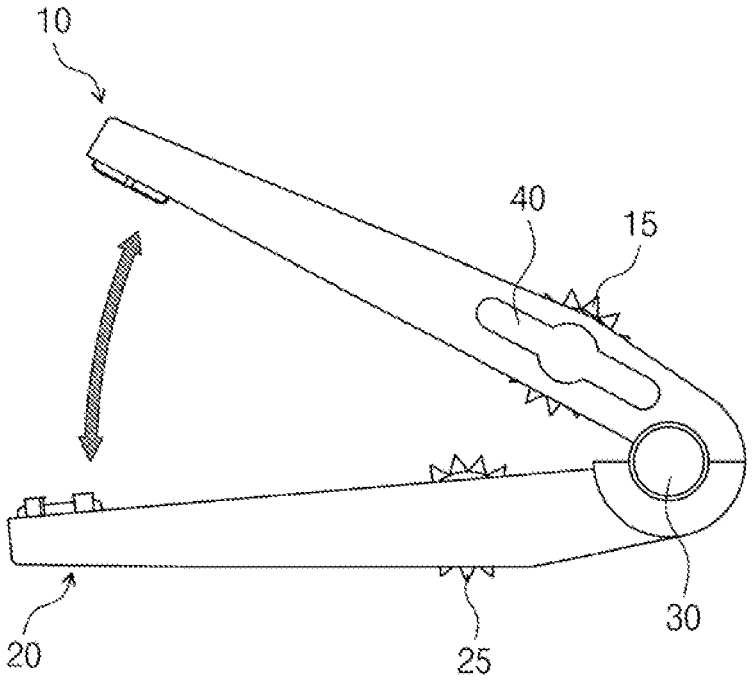
FIG. 2 is a view showing first and second main bodies relatively swinging.

FIG. 2 is a view showing the first and second main bodies relatively swinging.

Referring to FIG. 2, second ends of the second swing arms 21 are respectively connected to second ends of the first swing arms 11 to be swingable by a shaft 30, the shaft 30 extending in a direction defined as the spacing direction between the second swing arms 21. The second main body 20 may have a size corresponding to a size of the first main body 10. Accordingly, when the first main body 10 and the second main body 20 respectively swing to move the first handle 12 and the second handle 22 to be adjacent to each other, a user can hold the tube squeezer 1 in one hand.

A first roller 15 and a second roller 25 are positioned in the first main body 10 and the second main body 20, respectively.

The first roller 15 is rotatably provided in the first main body 10 so that a longitudinal direction thereof faces the spacing direction between the first swing arms 11. The first roller 15 is positioned in a section between the first handle 12 and the shaft 30. Protrusions may be formed on an outer surface of the first roller 15 with longitudinal directions equal to the longitudinal direction of the first roller 15. The first roller 15 may be formed in a cylindrical shape.

The second roller 25 is rotatably provided in the second main body 20 so that a longitudinal direction thereof faces the spacing direction between the second swing arms 21. The second roller 25 is positioned in a section between the second handle 22 and the shaft 30. Protrusions may be formed on an outer surface of the second roller 25 with longitudinal directions equal to the longitudinal direction of the second roller 25. The second roller 25 may be formed in a cylindrical shape.

A shaft (designated by reference numeral 16 in FIG. 4) of the first roller 15 and a shaft (designated by reference numeral 26 in FIG. 4) of the second roller 25 are provided at an angle θ on the basis of an alignment direction (hereinbelow, the alignment direction refers to a vertical direction) of the first swing arms 11 and the second swing arms 21 when the user holds the handles 12 and 22. A distance between one of the first and second rollers 15 and 25 and the shaft 30 is provided shorter than a distance between the other of the first and second rollers 15 and 25 and the shaft 30. As an example, a distance between the first roller 15 and the shaft 30 may be provided shorter than a distance between the second roller 25 and the shaft 30. The shaft 16 of the first roller 15 and the shaft 26 of the second roller 25 may be provided at angles θ between 15° and 40° to a vertical line.

One of the shaft 16 of the first roller 15 and the shaft 26 of the second roller 25 may be connected to a knob 40 positioned on a side surface of the first main body 10 or the second main body 20. As an example, the knob 40 may be connected to the shaft 16 of the first roller 15.

The pressure member 50 has a preset volume and is positioned on a portion where the first main body 10 and the second main body 20 are movably connected to each other. The pressure member 50 may be positioned in a direction opposite to a direction in which the knob 40 is positioned. The pressure member 50 includes a connecting part 51 and a pressure part 52.

The connecting part 51 is positioned adjacent to the portion where the first main body 10 and the second main body 20 are connected to each other. The connecting part 51 may be formed in a shape corresponding to a portion where one of the second ends of the first swing arms 11 and one of the second ends of the second swing arms 21 are movably connected to each other. As an example, the connecting part 51 may have a sectional area corresponding to the portion where one of the second ends of the first swing arms 11 and one of the second ends of the second swing arms 21 are connected to each other, and may have a circular outer circumference.

The pressure part 52 protrudes in a direction opposite to the first main body 10 and the second main body 20 from the connecting part 51. The pressure part 52 may be configured such that a sectional area perpendicular to a protruding direction thereof is reduced as the pressure part 52 goes outward from the connecting part 51. An end of the pressure part 52 may be rounded.

Figure 3:
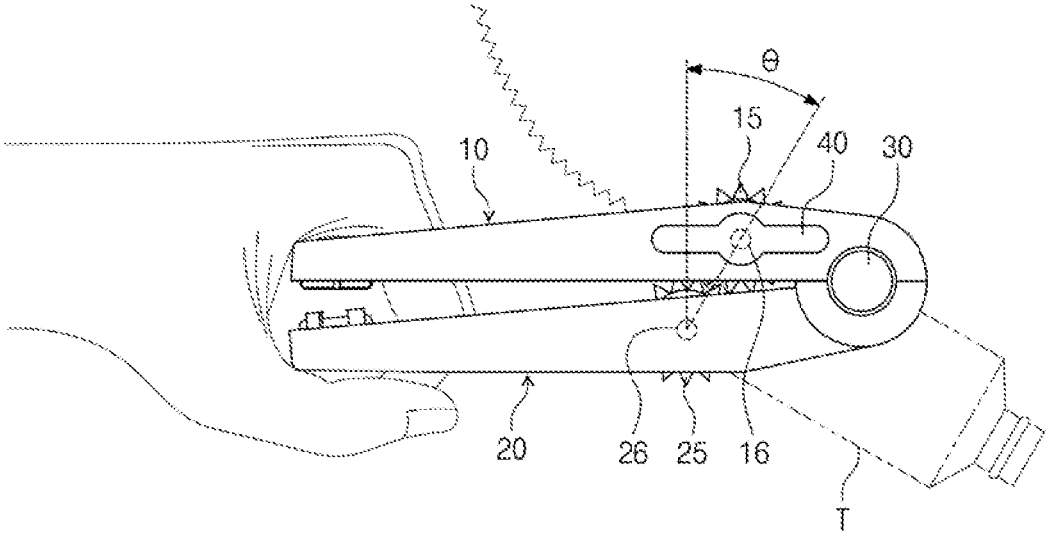
FIG. 3 is a view showing a use example of the tube squeezer in FIG. 1.

FIG. 3 is a view showing a use example of the tube squeezer in FIG. 1.

Referring to FIG. 3, the user positions a tube T between the first roller 15 and the second roller 25, and holds the first handle 12 and the second handle 22 in one hand. Then, the user rotates the knob 40 by the other hand, so that the first roller 15 and the second roller 25 are rotated. Accordingly, the tube T moves between the first roller 15 and the second roller 25 to squeeze contents in the tube T. As the shaft 16 of the first roller 15 and the shaft 26 of the second roller 25 are provided at an inclination, the tube T moves in a direction inclined to the swing arms 11 and 21, thereby preventing interference between the tube T and the user's hand.

In a process of squeezing the tube T, the user can control an opening of the tube T to face a lower side of the tube squeezer, whereby a falling position of the contents may be precisely controlled.

Figure 4:
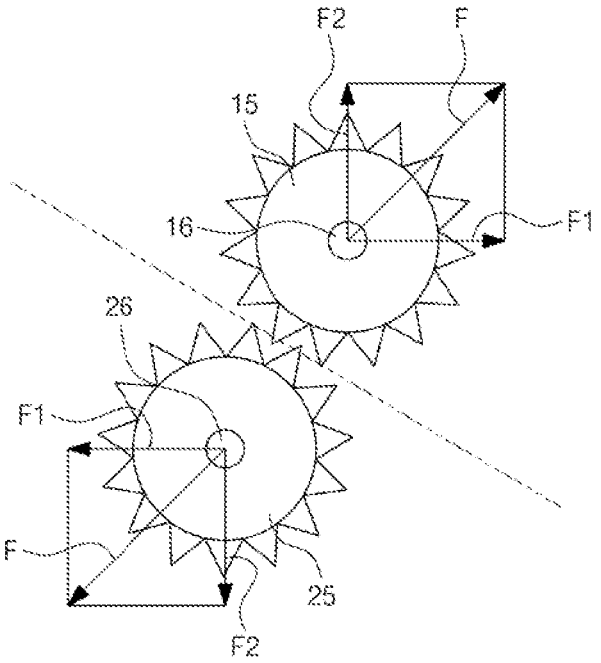
FIG. 4 is a view showing a force applied on the first and second main bodies by shafts of rollers.

FIG. 4 is a view showing a force applied by the shafts of the rollers on the first and second main bodies.

Referring to FIG. 4, each of the rollers 15 and 25 applies a force in a spacing direction of each of the shafts 16 and 26. Therefore, each of the shafts 16 and 26 applies a force F in the spacing direction of the shaft 16, 26 on each of the main bodies 10 and 20. A component F1 in a longitudinal direction of the swing arm 11, 21 does not damage to the body 10, 20, so that a component F2 in a direction causing the damage to the body 10, 20 is reduced.

Figure 5:
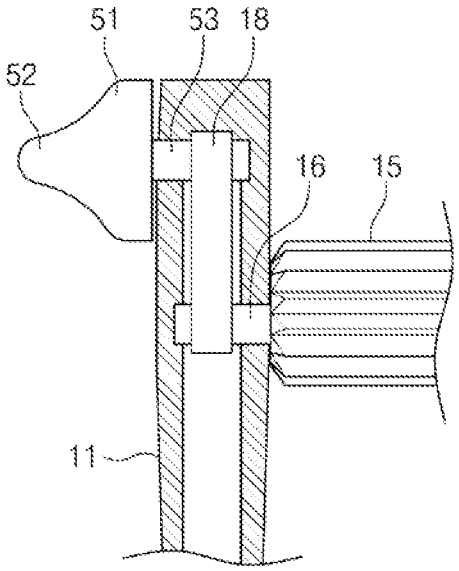
FIG. 5 is a sectional view taken along line A-A' in FIG. 1.

FIG. 5 is a sectional view taken along line A-A' in FIG. 1.

Referring to FIG. 5, the pressure member 50 may be connected to the first main body 10 by a supporting shaft 53. The supporting shaft 53 may be provided to be rotatable in the first main body 10. The supporting shaft 53 may be connected to the shaft 16 of the first roller 15 by a transmitting member 18. Inside the first main body 10, a space for positioning the transmitting member 18 is provided between the supporting shaft 53 and the shaft 16 of the first roller 15. The transmitting member 18 transmits a rotary force of the shaft 16 of the first roller 15 to the supporting shaft 53. As an example, the transmitting member 18 may be provided as a belt wound around an outer circumference defined by the shaft 16 of the first roller 15 and the supporting shaft 53, and as gears engaged with the shaft 16 of the first roller 15 and the supporting shaft 53.

Figure 6:
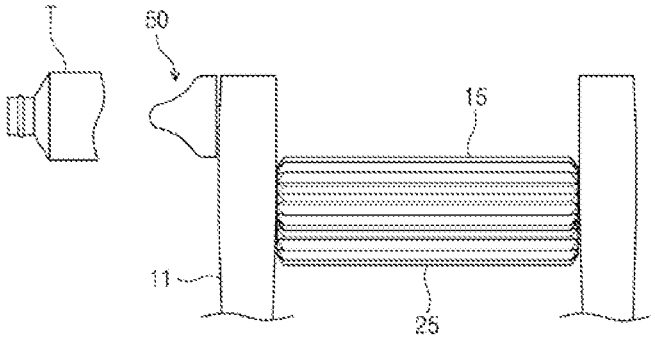
FIG. 6 is a view showing another use example of the tube squeezer.

FIG. 6 is a view showing another use example of the tube squeezer.

Referring to FIG. 6, when the tube T in almost empty is positioned such that a direction opposite to a content discharge direction faces the pressure member 50, the tube T is pressed by the pressure member 50. Whereby, the contents collected in an end of the tube T may be efficiently discharged. When necessary, the user can rotate the shaft 16 of the first roller 15 and the pressure member 50 using the knob 40, so that the contents may be efficiently discharged.

As described above, the preferred embodiment of the present disclosure has been disclosed for illustrative purposes. Furthermore, the present disclosure may be used in various combinations, modifications, and environment. That is, various modifications, additions and substitutions of the present disclosure are possible, without departing from the scope and spirit of the present disclosure as disclosed in the specification, the scope equal to the description, and/or the technical or knowledge scope of the present disclosure. The embodiment has been described the best mode for realizing the technical spirit of the present disclosure, and various modifications required in the specific application field and use of the present disclosure are possible. Accordingly, the disclosed embodiment is not intended to limit the present disclosure, and it should be understood that the scope of the accompanying claims includes various embodiments.

The invention claimed is:

1. A tube squeezer comprising:

a first main body comprising first swing arms and a first handle, the first swing arms spaced a preset distance apart from each other and the first handle extending between first ends of the first swing arms in a spacing direction between the first swing arms;

a second main body comprising second swing arms and a second handle, the second swing arms spaced a preset distance apart from each other, the second handle extending between first ends of the second swing arms in a spacing direction between the second swing arms, and second ends of the second swing arms respectively coupled to second ends of the first swing arms to be swingable around a shaft;

a first roller extending in a direction defined as the spacing direction between the first swing arms and rotatably coupled to the first main body such that the first roller is positioned in a section between the shaft and the first handle;

a second roller extending in a direction defined as the spacing direction between the second swing arms and rotatably coupled to the second main body such that the second roller is positioned in a section between the shaft and the second handle; and a pressure member having a preset volume and positioned on an outer surface of a portion around the shaft where the first main body and the second main body are movably coupled to each other, wherein a distance between one of the first and second rollers and the shaft is shorter than a distance between another of the first and second rollers and the shaft such that when the first and second handles are pressed to be adjacent to each other, a shaft of the first roller and a shaft of the second roller are obliquely positioned at a preset angle with respect to a vertical alignment direction of stacking the first and second bodies, wherein the pressure member comprises a connecting part and a pressure part which are integrated as a single member, the connecting part positioned on an outer surface of one of portions around the shaft where the second ends of the first swing arms and the second ends of the second swing arms are coupled to each other, the outer surface of the portion being positioned on an opposite side to one side of the first or second main body where the first or second main body is coupled to the first or second roller; and the pressure part formed to protrude from the connecting part in an outward direction from the first and second main bodies, the pressure part being configured such that a cross-sectional area thereof defined in a direction perpendicular to a protruding direction of the pressure part is gradually reduced as the pressure part goes outwards from the connecting part.

* * * * *